US006038697A

United States Patent [19]

Kasarnich

[11] Patent Number: 6,038,697

[45] Date of Patent: Mar. 21, 2000

[54] CARPENTER'S FINGER GUARD

[76] Inventor: Steven M. Kasarnich, 4429 Provens Dr., Akron, Ohio 44319

[21] Appl. No.: 09/137,229

[22] Filed: Aug. 20, 1998

[51] Int. Cl.[7] ..... A41D 13/00

[52] U.S. Cl. ..... 2/21; 2/160; 294/25; 602/22

[58] Field of Search ..... 2/21, 160, 460; 223/101; 602/22; 294/25

[56] References Cited

U.S. PATENT DOCUMENTS

| | | | |
|---|---|---|---|
| 1,761,356 | 6/1930 | McNamara | 2/21 |
| 2,461,970 | 2/1949 | Finegan | 2/21 |
| 2,925,605 | 2/1960 | Wheeler | 2/21 |
| 3,228,033 | 1/1966 | Ames et al. | 223/101 |
| 5,450,626 | 9/1995 | Sorrels | 2/21 |
| 5,647,063 | 7/1997 | Bates | 2/21 |

*Primary Examiner*—Diana Oleksa
*Assistant Examiner*—Katherine Moran
*Attorney, Agent, or Firm*—Renner, Kenner, Greive, Bobak, Taylor & Weber

[57] ABSTRACT

A finger guard for protecting a finger being used as a guide along the edge of work pieces such as acoustical tile and sheets of plywood and dry wall is provided. The finger guard is worn on the non-working hand and covers the area of the finger being drawn flush against the work piece. The finger guard is an egg shaped protective fabric having an elastic band attached thereto to fit the fabric over the area of the finger requiring protection. The wider area of the egg shaped fabric provides a large area of protection near the base of the finger while the tapering end of the fabric ensures that the dexterity of the finger tip is not compromised by the interference of fabric. The outer edge of the fabric is reinforced with stitching that also serves to attach the elastic band to the protective fabric. The elastic band is attached near the middle of the fabric so that, when the finger guard is worn, the elastic band also does not hinder the dexterity of the finger tip.

10 Claims, 1 Drawing Sheet

CARPENTER'S FINGER GUARD

TECHNICAL FIELD

The present invention generally relates to a finger guard for protecting a finger being used as a guide along an edge of a work piece. More particularly, the invention relates to a finger guard for use in cutting drywall and acoustical tile containing fiberglass or other particulate matter, as well as plywood and other sheet material the guard serving to protect the wearer's finger from the drying effects of gypsum in the drywall and, alternatively, from abrasion caused by the fiberglass or other particulate matter.

BACKGROUND ART

Drywall and acoustical tiling are commonly used in carpentry work. Drywall is commonly secured over the studs of a housing frame to create the walls of the room or similar structure. Acoustical tile is most often utilized in suspended ceilings, the individual acoustical tiles resting within the contours of the suspended grid or frame. Manufacturers of drywall and acoustical tile produce these items in designated sizes, for example, drywall is commonly obtained in 4×8 foot sheets and acoustical tiling is commonly obtained in 2×2 and 2×4 foot tiles.

As the wall or ceiling space allows, full sheets or tiles may be used during construction. However, drywall and acoustical tile must generally be cut to fit around corners, light fixtures, windows, and other similar design constraints common to walls and ceilings. Thus, the installment of drywall or a suspended ceiling is slowed down considerably by the time required to cut the needed dimensions out of the available standard sheet and tile sizes.

One method commonly used for trimming tile and drywall down to desired dimensions involves the use of a drywall "T" square. The "T" square consists of a ruler slidably attached perpendicularly to a flat guiding edge so that the ruler may be extended or retracted to measure off a specific distance from the guiding edge. Unwanted width or length may be trimmed from a work piece by sliding the ruler to extend beyond the guiding edge by the desired length to be removed, setting the guiding edge flush against the side of the work piece to be trimmed and, using the end of the ruler as a guide, running a utility knife along a line parallel to the edge of the work piece. In this manner, the desired dimensions can be achieved, while retaining the straight edge of the original work piece. The utilization of a combination square is still undesirably time consuming because of the time required to readjust the ruler setting for trimming different dimensions off of individual work pieces. Moreover, misplacement or temporary loss of the square, as with other tools, is a common problem.

Carpenters most commonly use a method similar to that employed in the use of a "T" square but that does not involve the unwanted time delay. In this method, the guiding edge of the "T" square is replaced by the carpenter's finger. The carpenter grips the ruler or tape measure at the desired trim length and places his index finger flush against the side of the work piece to be trimmed, placing the end of the ruler at the desired cutoff length. A utility knife is then run across the length of the work piece using the end of the ruler as a guide for the knife and the finger as a guide for the ruler. The end of the ruler is kept equidistant from the edge of the work piece by the carpenter's index finger which remains flush against the edge of the work piece as he guides the utility knife and ruler down its length. This method may also be used in conjunction with a carpenter's pencil to draw a guideline for trimming sheets of plywood and, indeed, it may be used in any number of instances where the dimensions of various work pieces must be marked off or cut. In this manner, a carpenter can quickly and accurately trim or mark off the dimensions of a work piece and can cut or mark off different lengths simply by gripping the ruler at a different position rather than having to deal with adjusting the slidable ruler of the combination square.

Using this method, the carpenter is faced with another set of problems. Acoustical tile commonly contains fiberglass or other particulate matter which cut at the skin on the carpenter's index finger as he drags it along the tile's edge. Similarly, drywall contains gypsum which can cause severe drying of the skin which leads to uncomfortable chaffing and cracking. When using this method to pencil in a straight line on a sheet of plywood, the carpenter is susceptible to picking up splinters.

To protect their fingers, many carpenters wrap their index finger with electrical tape to provide a layer of protection between their skin and the edge of the work piece. Electrical tape is commonly chosen because it provides a slick outside surface able to slide smoothly along the edge of the work piece. However, this protection method becomes time consuming in itself because, as the finger sweats, the electrical tape looses its adhesive properties and needs to be replaced. Furthermore, many carpenters, after taping their index finger numerous times, have experienced a loss of sensation in that finger possibly due to slight nerve damage caused by the tightly wound electrical tape. Furthermore, the tightly wound tape compromises the dexterity of the carpenter's finger, making it difficult for the carpenter to bend and flex the finger and grip various objects such as nails, screws, nuts, bolts and the like.

Others have used various types of gloves to provide the needed protection. Due to the heat inherent with wearing a glove, the three fingers and thumb of the gloves are usually cut off, leaving only the index finger remaining. This protection requires the unwanted expense of buying and subsequently destroying a pair of gloves. When the index finger of the glove wears out, a new pair must be bought and altered for its purpose.

It is therefore desirable to provide a finger guard for use in trimming or marking boards or tile that protects the finger from splinters, the drying effects of gypsum, the abrasive effects of fiberglass and other particulate matter; provides a surface that will slide well along the edge of a work piece; is inexpensive to replace; and can be permanently worn without compromising the dexterity of the carpenter's hand.

DISCLOSURE OF INVENTION

It is therefore an object of the present invention to provide a finger guard that protects a finger drawn flush along an edge of a work piece commonly used by carpenters.

It is a further object of the present invention to provide a finger guard that slides smoothly along an edge of a work piece.

It is another object of the present invention to provide a finger guard that is simple to employ and inexpensive to replace.

It is yet another object of the present invention to provide a finger guard that does not hinder the finger dexterity of the wearer.

The foregoing and other objects of the invention which will become apparent herein are attained by a finger guard for protecting a finger being used as a guide along an edge of a work piece, comprising: a protective fabric adapted to cover the guiding surface of the finger being used as a guide along an edge of a work piece; and a fastening means for securing said protective fabric to the finger being used as a guide along an edge of a work piece.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
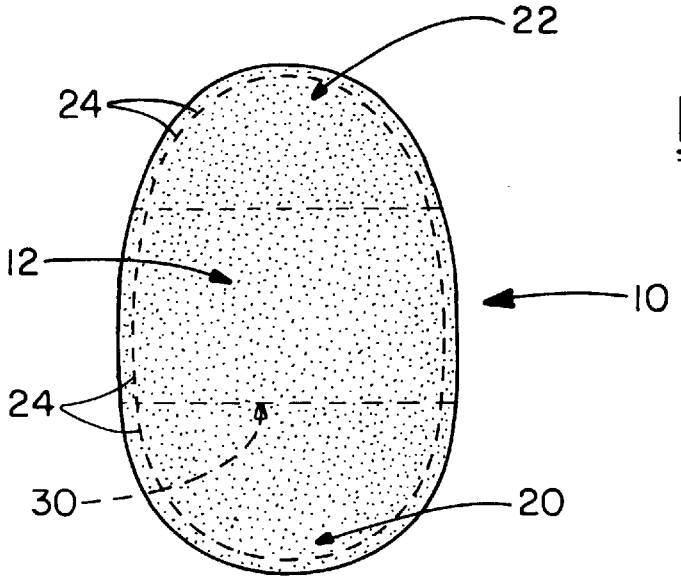
FIG. 1 is a front view of the preferred embodiment of the finger guard of the present invention.

Referring to FIG. 1, it can be seen that the finger guard of the present invention is designated generally by the numeral 10. The finger guard 10 has a protective material 12 that is generally egg-shaped. The protective material 12 is shaped with a wide back end 20 and a tapered front end 22. When the finger guard 10 is worn, the wide back end 20 fits near the knuckle of the finger adjacent the palm while the tapered front end 22 fits near the tip of the finger. It has been found that a universally sized guard is accomplished by an egg-shape that is about 2⅝ inches from tapered front end 22 to wide back end 20 and about 1¾ inches across near its midpoint. When practicing the best mode of the present invention, these dimensions are preferred although they should in no way be read to limit the scope of the present invention and other dimensions may be utilized depending upon the size of the finger to be protected. Therefore, the dimensions of the protective material 12 needed to supply adequate protection to an individual finger may vary from about 1½ to 4 inches in length and from about ⅔ to 2¼ inches in width. However, inasmuch as the dimensions are dictated by the size of the finger and desired degree of protection the present invention is not limited to any specific recitation thereof.

The design disclosed above provides maximum protection to the finger, while leaving the fingertip free from undue obstruction and affording significant finger dexterity. The tapered shape allows the wearer to use his fingers for holding and manipulating small objects commonly used during carpentry work, such as, nails, staples, screws, bolts, washers, and other similar items. While the preferred shape herein disclosed is a basic egg shape, it should be appreciated that any tapered shape which provides the needed protection and allows for the desired finger dexterity is within the scope of the present invention. It will be appreciated that the egg shape presents maximum material at the base of the finger where the finger diameter is largest, and tapers to the end, as does the finger.

It is preferred that 3 pound suede be used as the protective material 12 in as much as has been found to provide substantial protection while providing a comfortable fit and a smooth guiding surface. The 3 pound suede also displays superior resistance to drying and cracking from the effects of gypsum and drywall. While 3 pound suede is preferred, it should be appreciated that any protective material will fall within the scope of the present invention. Furthermore, the preferred thickness of the 3 pound suede is ⅛ inch; however, different thicknesses may be utilized and indeed may be necessitated if a different protection material 12 is employed, and it should be appreciated that differing dimensions fall within the scope of the present invention.

The outside edge of the protective material 12 is reinforced by sewing or stitching 24 that extends continuously around the protective material 12 in close proximity to the outside edge thereof. The stitching 24 also serves to affix an elastomeric band 30 to the back side of the finger guard 10.

Figure 2:
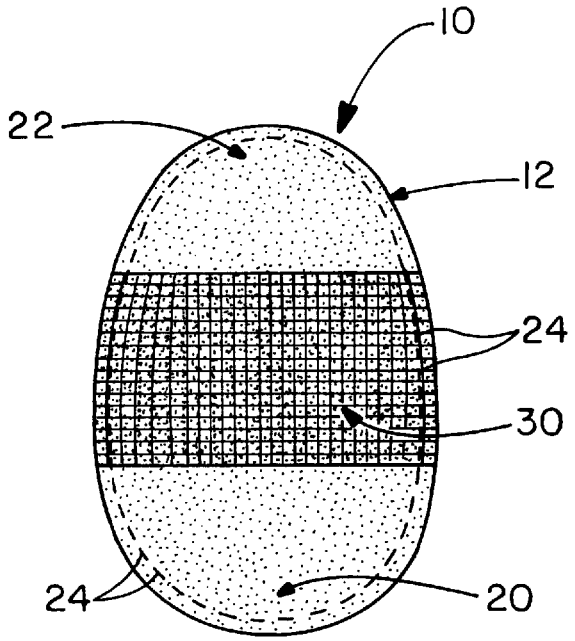
FIG. 2 is a back view of the preferred embodiment of the present invention.

Referring now to FIG. 2, it can be seen that the elastomeric band 30 is positioned around the middle of the back side of the protective material 12 in such a way that when the finger guard 10 is worn, the elastomeric band 30 does not hinder the bending of the finger's distal interphalangeal joint.

Similarly, it is preferred that the elastomeric band attaches to the finger guard 10 in such a manner that it does not significantly hinder the bending of the middle interphalangeal joint. Keeping in mind that the finger guard 10 should fit snugly enough to remain in place while being worn, it is desired that the elastomeric band 30 fits loosely enough to avoid affecting circulation to the rest of the finger or otherwise causing discomfort.

Figure 3:
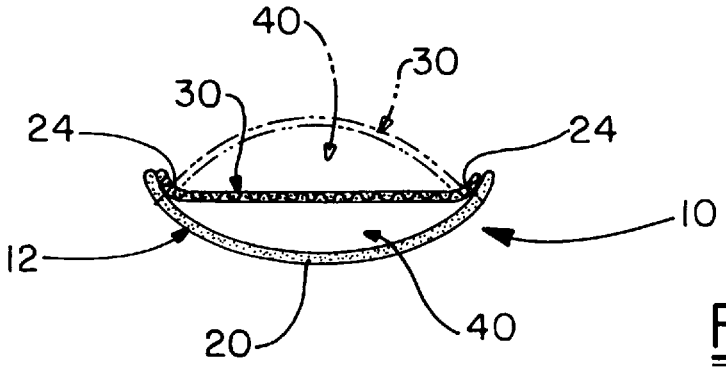
FIG. 3 is a side view of the preferred embodiment of the present invention.

Referring now to FIG. 3, it can be seen that a snug and yet comfortable fit is accomplished by attaching the elastomeric band 30 to the protective material 12 in such a way that the finger guard 10 is crimped and provides an elliptical insertion area 40 for the finger. The insertion area 40 should not be so small that it creates a tight and uncomfortable fit and should not be so large that it provides a loose fit. Such a fit can be facilitated through the use of a softer elastomeric material.

It should be appreciated that, while the preferred embodiment of the present invention fits the finger guard 10 on the wearer's finger by providing an elastomeric band 30 sewn to the back of the protective material 12 in such a manner as to provide an insertion area 40 for the finger, other materials and means for fitting the protective material 12 on the finger may be employed and fall within the scope of the present invention.

In use, the finger guard 10 is placed over the index finger of the user's guiding hand so that the elastomeric band 30 fits around the area of the finger's middle interphalangeal joint. The elastomeric band 30 does not unduly hinder the movement of this joint and provides the distal interphalangeal joint with a free range of movement. The wide back end 20 extends toward the primary interphalangeal joint while the tapered end 22 extends toward the tip of the finger. Wearing the finger guard 10 in this manner, the wearer is able to protect his finger when using it as a contacting guide for making precise dimensional lines or cuts on various work pieces while still preserving the finger dexterity needed for other various jobs.

Thus it can be seen that the objects of the invention have been satisfied by the structure presented hereinabove. While in accordance with the patent statutes, only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A finger guard for protecting a finger being used as a guide along an edge of a work piece, comprising:

a protective fabric shaped to cover the guiding surface of the finger being used as a guide along an edge of a work piece while leaving the finger tip uncovered so as not to interfere with the bending of the distal interphalangeal joint; and a fastening means for securing said protective fabric to the finger being used as a guide along an edge of a work piece, wherein said fastening means contorts the protective fabric to provide an insertion area for the finger being used as a guide along an edge of a work piece, and said fastening means is positioned in the area near the middle of said protective fabric such that, when the finger guard is worn, said fastening means does not interfere with the bending of the distal interphalangeal joint of the finger being used as a guide along an edge of a work piece.

2. A finger guard according to claim 1, wherein said protective fabric is tapered at one end thereof.

3. A finger guard according to claim 2, wherein said protective fabric is egg shaped.

4. A finger guard according to claim 3, wherein said protective fabric is leather.

5. A finger guard according to claim 3, wherein said protective fabric is 3 pound suede leather.

6. A finger guard according to claim 5, wherein said protective fabric is from about 1.5 to 4 inches in length and from about 0.75 to 2.25 inches in width.

7. A finger guard according to claim 1, further comprising stitches along the edge of said protective fabric to reinforce and prevent fraying of the edges of said protective fabric.

8. A finger guard according to claim 2, wherein said stitches attach said fastening means to said protective fabric.

9. A finger guard for protecting a finger being used as a guide along an edge of work piece, comprising:

a protective fabic shaped to cover the guiding surface of the finger while leaving the finger tip uncovered; and a fastening means for securing said protective fabric to the finger, wherein said fastening means is positioned in the area near the middle of said protective fabric such that, when the finger guard is worn, said fastening means does not interfere with the bending of the distal interphalangeal joint of the finger.

10. A finger guard according to claim 9, wherein said fastening means is elastic.

* * * * *